United States Patent [19]

Syrylo, Jr. et al.

[11] Patent Number: 4,922,742

[45] Date of Patent: May 8, 1990

[54] APPARATUS FOR PRECISION FORMING OF SHEET METAL PARTS

[75] Inventors: Stephen N. Syrylo, Jr., White Marsh; Madison L. Deal, Baltimore, both of Md.

[73] Assignee: Westinghouse Electric Corp., Pittsburgh, Pa.

[21] Appl. No.: 267,082

[22] Filed: Nov. 3, 1988

[51] Int. Cl.[5] ..... B21D 5/04

[52] U.S. Cl. ..... 72/308; 72/312; 72/389; 72/461; 72/465

[58] Field of Search ..... 72/308, 309, 311, 389, 72/461, 414, 312, 313, 465

[56] References Cited

U.S. PATENT DOCUMENTS

| | | | |
|---|---|---|---|
| 625,789 | 5/1899 | Macbeth | 72/313 |
| 939,468 | 11/1909 | Boyce | 72/414 |
| 2,362,006 | 11/1944 | Herzog | 72/396 |
| 2,900,943 | 8/1959 | Tiedemann | 72/312 |
| 3,225,584 | 12/1965 | Begg et al. | 72/461 |
| 3,276,239 | 10/1966 | Achler et al. | 72/465 |
| 3,740,996 | 6/1973 | Hix | 72/461 |
| 3,978,706 | 9/1976 | Nakagawa et al. | 72/465 |
| 4,131,008 | 12/1978 | Malatto | 72/389 |
| 4,561,281 | 12/1985 | Tran et al. | 72/389 |

FOREIGN PATENT DOCUMENTS

| | | | |
|---|---|---|---|
| 35140 | 1/1965 | German Democratic Rep. | 72/396 |
| 30428 | 2/1984 | Japan | 72/389 |
| 30526 | 2/1985 | Japan | 72/389 |
| 1152687 | 4/1985 | U.S.S.R. | 72/461 |

*Primary Examiner*—Daniel C. Crane

[57] ABSTRACT

A lower die assembly used in a bending machine to form pre-punched three-dimensional structures has a plurality of plungers located within the V-shaped bending slot of the lower die. As the upper die presses against the pre-punched sheet, the sheet is pinched between an upper end surface of the plungers and the rounded end of the upper die so as to maintain the prescribed position of the sheet during bending. The lower die may include a pin stop which cooperates with positioning holes pre-punched in the sheet in order to establish the desired position of the sheet prior to bending.

15 Claims, 2 Drawing Sheets

APPARATUS FOR PRECISION FORMING OF SHEET METAL PARTS

BACKGROUND OF THE INVENTION

1. Field of the Invention

The present invention relates generally to metal working, and more specifically, to an apparatus and method for pecision forming of sheet metal parts without transfer drilling. The invention also relates to three-dimensional structures made using the apparatus and method, wherein attachment holes are punched before bending in order to eliminate transfer drilling during assembly.

2. Description of the Related Art

The manufacturer of large, geometrically complex structures, such as radar antennas, normally involves extensive machining, e.g., transfer drilling, in order to assemble components of a particular structure. In prior methods of forming reflector ribs of a radar antenna, a series of flat contour-punched plates with pre-located attachment holes are assembled with pre-drilled, machined extrusion corner clips which are riveted to each end of the rib, and then riveted to the main vertical ribs. Contour-punching is generally known in the art, and refers to the act of cutting a sheet to a desired shape by making a series of punched cuts.

The assembly of these parts is then performed in a holding fixture which supports the outboard ribs in their pre-determined position. The remaining major and minor ribs are then sequentially fastened. At the final assembly, the contoured reflector assembly is positioned in its required attitude and fastened to an independent support structure by transfer drilling and bolted through a series of reflector support angles.

The support structure is made of a series of sheet metal box beams, each of which is formed by assembling pre-punched flat panels and sheet metal channels which are bent up to conventional sheet metal tolerances. Internal bulkheads used in the assembly are conventional two-part structures which allow for take-up of dimensional variation in the beam dimensions. All sheet metal parts are contour-punched and bent from a reference edge of the flat, pre-bent sheet. In order to join the sheet metal to cast frame members, the parts are transfer drilled and rivets are installed in the drilled holes.

Transfer drilling has been required in the past because sheet metal bending techniques have not been capable of providing sufficiently close tolerances such that pre-punched holes would align between juxtaposed structural parts after bending.

The inventors herein developed a new method in which each plate is at first contour-punched and then hole-punched to include attachment holes and bending tool holes. The plate ends were then precisely bent from the bending tool holes to form integral mounting flanges. After bending, the attachment holes were disposed in the mounting flanges. By using the bending tool holes to position the metal sheet on the bending machine, the attachment holes, which were pre-punched, were capable of being located within precise dimensional tolerances previously achievable only by machining. Since machining is both costly and time consuming, the pre-punching of attachment holes provided fabrication of three-dimensional assemblies with a minor number of parts and a minimum amount of transfer drilling at assembly. The attachment holes of one part precisely matched those in an adjacent part or complementary part in forming a structural component of an assembly. The use of integral end flanges eliminated the need for separate corner clips since, at each joint, rivets were inserted through the common holes, thereby reducing the total number of attachments.

The method developed by the inventors also permitted the integration of contoured reflective parts into a main support structure of the reflector assembly. Selected main, vertical and horizontal contoured ribs were joined together by precision bent sheet metal channels riveted between a pair of ribs. The matching attachment hole patterns in the ribs and channels were punched prior to forming. Also, hole patterns for internal bulkheads were pre-punched to match corresponding holes in both the contoured ribs and the channels. Cast frames and bulkheads in the assembly were all drilled by a machine controlled by a numeric control unit so as to match the geometry and hole patterns in the adjoining sheet metal parts. Thus, even though the attachment holes are bent into a different plane, tolerances of about 0.005 inch are achievable over the entire length of the bent portion of the sheet metal. In the past, bending sheet metal up to about ten feet long was performed without pre-punching attachment holes since, the achievement of close tolerances for attachment holes along the entire length would have been extremely difficult.

The method described above uses a standard bending machine in which an upper die descends towards a lower die as tonnage is applied through opposite side rams. A lower die used in the standard bending machine which facilitates the method of forming sheet metal in which sheets are first punched and then bent is considered part of the present invention.

A problem common to the die of the present invention, which permits close tolerance bending, and other dies, is that sometimes when the bending machine rams cause the upper die to descend, unequal pressure from the rams may cause the upper die to move unevenly downward. Also, imperfections in either the upper die or lower die, or both, may cause the upper die to contact the hole-punched sheet unevenly, thus causing the sheet to move slightly relative to the die. This problem is detrimental to maintaining close tolerances and is particularly acute for metal sheets made of aluminum due to the bending characteristics of aluminum.

SUMMARY OF THE INVENTION

An object of the present invention is to provide an apparatus and method for forming sheet metal to obtain dimensional tolerances for matching attachment holes previously achieved only by machining.

Another object of the invention is to provide an apparatus and method for forming sheet metal in the fabrication of three dimensional assemblies which reduces to a minimum the number of required parts and the amount of transfer drilling required during assembly.

Another object of the invention is to provide a die used in a metal bending machine which prohibits movement of the sheet after placement on the die.

Another object of the invention is to provide a die for use in a metal bending machine which prohibits movement of the sheet relative to the die after initial contact of the sheet with the upper die of the bending machine.

Another object of the invention is to provide a beam structure made out of only two pieces of sheet metal, each piece being bent after punching attachment holes therein.

These and other objects of the invention are met by providing a lower die assembly mountable on a die block of a bending machine having an upper die movable above the lower die, the lower die including a first die body having an upper surface, a lower surface, and opposite side walls, a bending slot formed longitudinally in the upper surface of the first die body, means disposed at the lower surface of the first die body for fixing the longitudinal position of the first die body along the die block, a second die body having an upper surface, a lower surface, and opposite side walls, and having one side wall detachably connected to one side wall of the first die body, the upper surfaces of the first and second die bodies being coplanar and forming a sheet retaining surface, and at least one pin stop extending upwardly from the upper surface of the second die body at a predetermined distance from the slot of the first die body for mating with a sheet positioning hole punched in a piece of sheet metal to be bent.

Preferably, the lower die assembly includes means associated with the bending slot for cooperating with the upper die to hold the piece of sheet metal in place when a bending force is applied through the upper die.

These objects, together with other objects and advantages which will be subsequently apparent reside in the details of construction and operation of the apparatus and method as more fully hereinafter described and claimed, referece being had to the accompanying drawings forming a part thereof, wherein like reference numerals refer to like parts throughout.

DETAILED DESCRIPTION OF THE PREFERRED EMBODIMENTS

Figure 1:
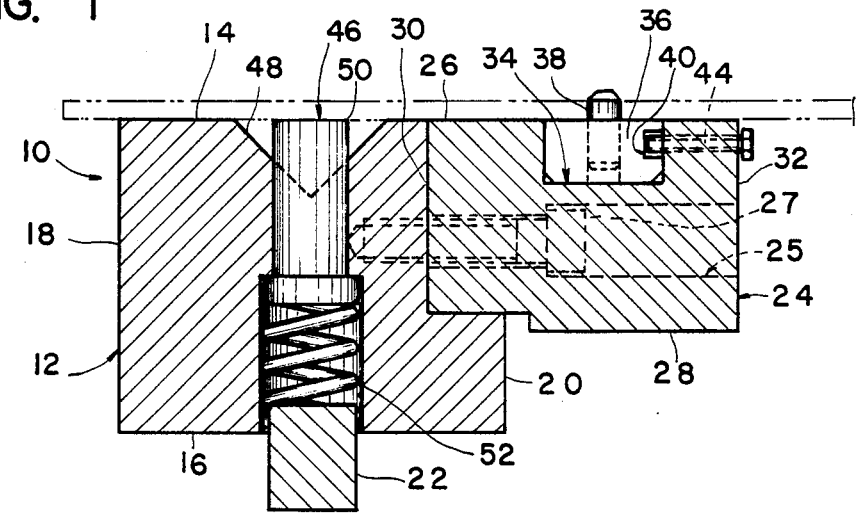
FIG. 1 is a cross-sectional view of a first preferred embodiment of the lower die assembly according to the present invention.
Figure 2:
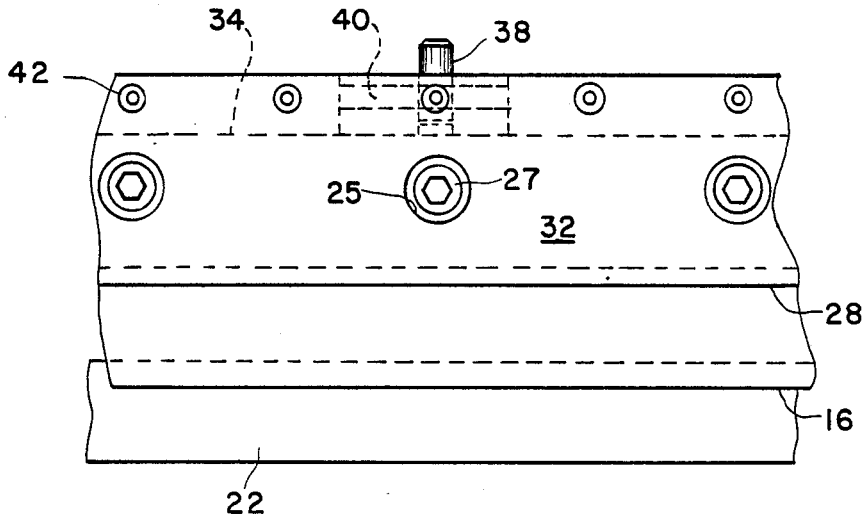
FIG. 2 is a side elevational view of a portion of the lower die assembly of FIG. 1.

Referring now to FIGS. 1 and 2, a die assembly 10 of a first preferred embodiment of the present invention includes a first die body 12 having an upper surface 14, a lower surface 16, and opposite side walls 18 and 20. A tongue 22 extends downwardly from the lower surface 16 of the first die body 12 and provides means for fixing the longitudinal position of the first die body 12 along a die block (not shown) of a bending machine. Typically, the die block of a bending machine has a groove into which the tongue 22 is receivable. Clamping means associated with the die block groove holds the tongue firmly when the die body 12 is in its proper position. While the lower die assembly 10 of the present invention may be used for bending sheet metal about ten feet in length, the lower die assembly 10 is typically in lengths of 3 feet or less. In order to bend longer sheets, multiple loer die assemblies would be positioned end to end on the die block of the bending machine.

A second die body 24 has an upper surface 26, a lower surface 28 and opposite side walls 30 and 32. A groove 34 is provided in the upper surface 26 of the second die body 24 and extends longitudinally to provide a track for a sliding block 36 slidably received therein. The lower corners of the sliding block 36 are chamfered to facilitate sliding in the longitudinal direction, while maintaining zero play at the side walls to prevent lateral movement of the block. The upper surface of the block 36 and the upper surfaces of the first and second die bodies 12 and 24, respectively, are copolanar and define a plate retaining surface. In order to attach the second die body 24 to the first die body 12, counter-sunk bores 25 are provided in the second die body 24. Screws 27 extend into the bores 25 and threadly engage the first die body 12.

The block 36 is provided with a pin 38 which extends upwardly from the plate receiving surface so as to mate with positioning holes punched in the plate. The pin 38 may be integrally formed with, fixedly attached to, or floating within a bore of the sliding block 36. The positioning holes of the sheet metal sheets are pre-punched along with the attachment holes before placement of the flat sheet on the lower die assembly 10. The tip of the pin 38 is bevelled to ease insertion of the pin 38 in a corresponding positioning hole. The piece of sheet metal to be bent is fed (viewing FIG. 1) from the right. The positioning holes and pins eliminate the need for a back stop which is normally disposed on the left side of the lower die, but as a separate element not connected to the lower die.

The block 36, and thus the pin 38, is positionally adjustable as required along the groove 34 of the second die body 24. The block 36 is provided with a groove 40 in one of the side walls thereof. The groove 40 faces a plurality of threaded bores 42 which extend laterally through a portion of the second die body 24 at spaced intervals. A set screw 44 is receivable in any one of the threaded bores 42, depending on the desired position of the pin 38. When the block is in a predetermined position, the set screw 44 is placed in a threaded bore closest to the center of the block 36 and advanced inwardly until an inward end of the set screw abuts the inwardmost wall of the groove 40.

A plurality of plungers 46 (of which only one is shown in FIG. 1) are arranged at equidistantly spaced intervals centrally in a V-shaped bending slot 48 formed in the upper surface 14 of the first die body 12. Each plunger 46 has an upper end surface 50 which is substantially coplanar with the upper surfaces 14 and 26 of the first and second die bodies 12 and 24, respectively. A spring 52 is provided for each plunger 46 in order to bias the plunger upwardly into the extended position shown in FIG. 1. Each plunger has a spring force of about 8 lbs., in one embodiment, but the spring force can be varied as necessary. However, the spring force for all plungers of a given die should be the same.

Since the sheet (shown in broken lines in FIG. 1) is pre-punched to include positioning holes, and since the location of the positioning holes is predetermined, the second die body 24 is positioned on the first die body 12 where appropriate and the pin block 36 is positioned and set accordingly by means of the set screw 44. The sheet is then placed on the sheet retaining surface with the positioning holes formed therein placed over the pins 38 of the pin block 36. Each pin block 36 may be provided with more than one pin 38. Since it is contemplated that the sheet metal may be ten feet or longer in length, a plurality of first and second die bodies may be required to accommodate the entire length of the sheet.

When a bending force is applied to the piece of sheet metal laid upon the lower die assembly 10, the sheet metal is pinched between the nose of the upper die and the upper end surfaces 50 of the plurality of plungers 46. Due to the fact that the plungers are spring loaded, the plungers 46 depress into the first die body 12 as the nose of the upper die descends into the V-shaped bending slot 48. The nose of the upper die (also known as a "punch") has a radius which is specified to cooperate with the angled surfaces of the V-shaped bending groove 48 in order to provide the predetermined angle of bend and radius of bend.

Thus, in the method of the present invention, a piece of sheet metal is contour-punched and hole-punched to include a plurality of attachment holes and positioning holes. Then, the pre-punched piece is laid upon a lower die of a bending machine and held in place by pin stops extending upwardly from the lower die. The upper die of the bending machine is then lowered into contact with the piece of sheet metal, whereupon the sheet metal is pinched between plungers disposed in a bending slot of the lower die, and the upper die. The pinching of the piece of sheet metal continues as the bed is made such that the piece is held firmly in its predetermined position throughout bending. The pinching attributable to the plungers is suitable for dies having pin stops, or conventional dies which use back stops (to position the sheet for bending at the lateral edge).

Figure 3:
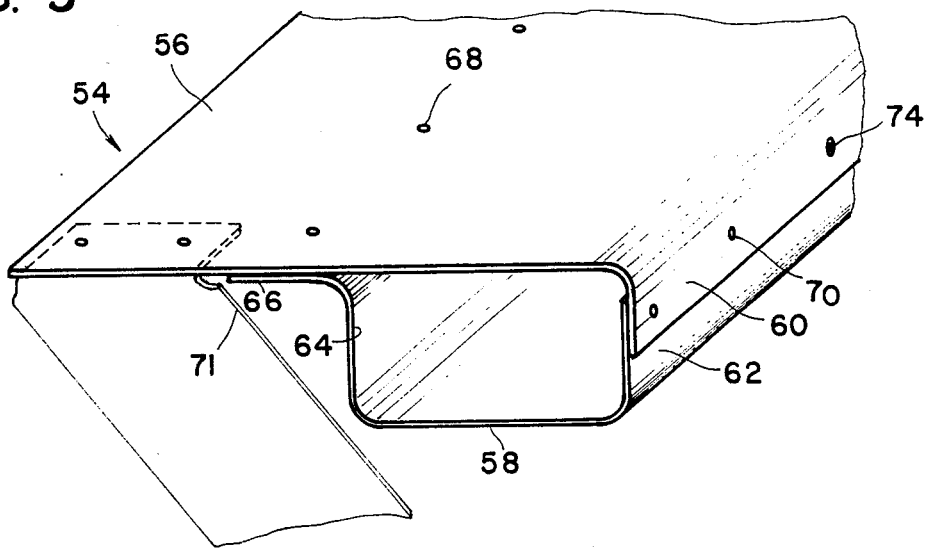
FIG. 3 is a perspective view of a portion of a beam made according to the present apparatus and method of forming sheet metal.

Referring to FIG. 3, a beam 54, such as what may be used as part of the reflector support structure of a radar antenna, is constructed according to the aforementioned method using the lower die assembly illustrated in FIGS. 1 and 2. The beam 54 includes a first piece of sheet metal 56 which is pre-punched to include a plurality of attachment holes 68 and 70. After punching, the first piece 56 is bent to include an attachment portion 60 which includes the attachment holes 70. A second piece 58 of sheet metal is similarly pre-punched to include a plurality of attachment holes and positioning holes and is bent after being pre-punched to form an attachment portion 62, a side wall 64, and a flange 66 in a series of three different bending maneuvers. The second piece of sheet metal 58 has two lateral edges and is pre-punched to include a plurality of attachment holes and positioning holes, and is bent after being pre-punched so that a portion of the attachment holes are located in the attachment portion 62 and the remainder are in the flange 66. The flange 66 overlaps a portion of the first piece of sheet metal 56 in an area where attachment holes 68 are formed. The aligned attachment holes between the first and second pieces receive fasteners, such as rivets, in order to attach the two pieces. Similarly, the attachment portions 60 and 62 of the first and second pieces 56 and 58, respectively, overlap to match attachment holes 70 which receive fasteners to complete the assembly of the two pieces. The two attachment portions 60 and 62 form a second side wall substantially parallel to side walls 64. The horizontal beam formed by assembly of the two pieces provides a contoured horizontal rib which is connected to a contoured vertical rib 71 by means of additional attachment holes.

Figure 4:
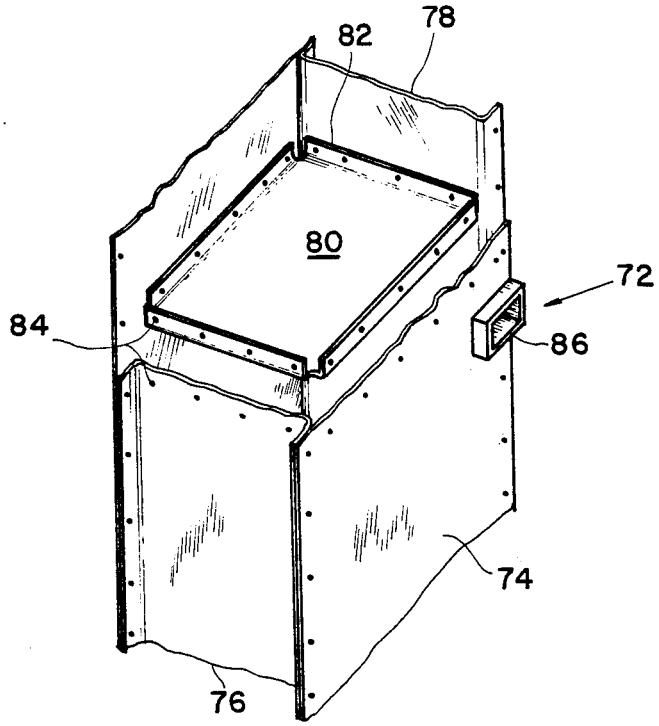
FIG. 4 is a portion of a tower assembly for mounting the panels of a radar antenna.

Referring to FIG. 4, a second embodiment of a sheet metal beam 72, which may form a part of the reflector support structure of a radar antenna, is fabricated according to the methods and apparatus previously described. The beam 72 includes opposite side plates 74 which are pre-punched, but not bent. Opposite end plates 76 and 78 are also pre-punched, and also bent along the lateral edges thereof using the apparatus and method previously described. A plurality of bulkheads 80 (only one of which is shown) are assembled with the various side and end plates to form the beam structure. Each bulkhead 80 is bent at the lateral and longitudinal ends such that attachment holes 84 of the various components match for assembly by fasteners.

Due to the precision tolerance obtainable by using the method and apparatus of the present invention, it is possible to attach a machined reflector panel support 86 which facilitates the assembly of the radar antenna on site. Since the radar antenna may be as large as 42 feet by 36 feet, it is preferable to prefabricate multiple panels and separately attach each one to the corresponding panel supports 86 attached to the reflector supports (referred to as the "beam" 72). Previous radar antenna were made with one large reflector panel which was permanently connected to the reflector support, or with a plurality of panels which required extensive alignment on site for panel replacement. Due to the precision tolerances achievable by using the method and apparatus of the present invention, it is possible to use a plurality of panel supports 86 to connect a plurality (six) of reflector panels to the support structure on site, thus assuring reflector contour repeatability and enabling replacement, repair, etc., of individual panel members.

The many features and advantages of the present invention are apparent from the detailed specification, and thus, it is intended by the appended claims to cover all such features and advantages of the precision forming of sheet metal parts which fall within the true spirit and scope of the invention. Further, since numerous modifications and changes will readily occur to those skilled in the art based upon the disclosure herein, it is not desired to limit the invention to the exact construction and operation illustrated and described. Accordingly, all suitable modifications and equivalents may be resorted to, falling within the scope and the spirit of the invention.

What is claimed:

1. A lower die assembly mountable on a die block of a bending machine for bending a piece of sheet metal and having an upper die movable above the lower die, the lower die comprising:

a first die body having an upper surface, a lower surface, and opposite side walls;

a bending slot formed longitudinally in the upper surface of the first die body, and cooperating with the upper die for effecting a bend in the piece of sheet metal;

means, disposed at the lower surface of the first die body, for fixing the longitudinal position of the first die body along the die block;

a second die having an upper surface, a lower surface, and opposite side walls, and having one side wall detachably connected to one side wall of the first die body, the upper surfaces of the first and second die bodies being coplanar and forming a sheet retaining surface for receiving thereon a sheet having attachment holes and positioning holes thereon;

at least one pin stop extending upwardly from the upper surface of the second die body at a predetermined distance from the slot formed in the upper surface of the first die body, for mating with one of the sheet positioning holes of the sheet; and means, cooperating with the upper die, for holding the punched sheet in place when a bending force is applied to the sheet through the upper die, said holding means being mounted in said first die body.

2. A lower die assembly as recited in claim 1, further comprising means for adjusting the longitudinal position of the pin stop.

3. A lower die assembly as recited in claim 2, wherein the means for adjusting the longitudinal position of the pin stop comprises a groove formed longitudinally in the upper surface of the second die body parallel to the slot of the first die body, a pin block slidably received in the groove of the second die body, and means for fixing the longitudinal position of the pin block.

4. A lower die assembly as recited in claim 3, wherein the pin block has an upper surface, a lower surface, and opposite side walls, and the means for fixing the longitudinal position of the pin block comprises a longitudinal groove formed in one of the side walls of the pin block, a plurality of threaded bores extending laterally through the second die body from one side wall thereof to the longitudinally extending groove of the die block, and a set screw threadedly engaging one of the threaded bores and having an inward end movable into abutment with the pin block to fix the position of the pin block at a predetermined longitudinal position.

5. A lower die assembly as recited in claim 1, wherein the holding means comprises at least one plunger resiliently mounted centrally in the slot of the first die body and having an upper end surface which is substantially coplanar with the upper surfaces of the first and second die bodies, the sheet when placed thereon being pinched between the upper end surface of the plunger and the upper die upon application of a bending force to the punched sheet.

6. A lower die assembly as recited in claim 5, further comprising a plurality of plungers equidistantly spaced apart along a length of the slot of the first die body.

7. A lower die assembly as recited in claim 6, wherein each plunger is spring biased into an extended position in which the upper end surface is substantially coplanar with the upper surfaces of the first and second die bodies.

8. A lower die assembly mountable on a die block of a bending machine for bending a punched sheet having an upper die movable above the lower die, the lower die comprising:

a first die body having an upper surface, a lower surface, and opposite side walls;

a bending slot formed longitudinally in the upper surface of the first die body, and cooperating with the upper die for effecting a bend in the punched sheet;

means, disposed at the lower surface of the first die body, for fixing the longitudinal position of the first die body along the die block;

means cooperating with the upper die for holding the punched sheet in place when a bending force is applied to the sheet through the upper die said holding means being mounted in said first die body;

a second die body having an upper surface, a lower surface, and opposite side walls, and having one side wall detachably connected to one side wall of the first die body, the upper surfaces of the first and second die bodies being coplanar and forming a sheet retaining surface for receiving thereon a sheet having attachment holes and positioning holes thereon;

at least one pin stop extending upwardly from the upper surface of the second die body at a predetermined distance from the slot formed in the upper surface of the first die body, for mating with one of the sheet positioning holes of the sheet; and means for adjusting the longitudinal position of the pin stop, wherein the means for adjusting the longitudinal position of the pin stop comprises a groove formed longitudinally in the upper surface of the second die body parallel to the slot of the first die body, a pin block slidably received in the groove of the second die body, and means for fixing the longitudinal position of the pin block.

9. A lower die assembly as recited in claim 8, wherein the pin block has an upper surface, a lower surface, and opposite side walls, and the means for fixing the longitudinal position of the pin block comprises a longitudinal groove formed in one of the side walls of the pin block, a plurality of threaded bores extending laterally through the second die body from one side wall thereof to the longitudinally extending groove of the die block, and a set screw threadedly engaging one of the threaded bores and having an inward end movable into abutment with the pin block to fix the position of the pin block at a predetermined longitudinal position.

10. A lower die assembly as recited in claim 9, wherein the holding means comprises at least one plunger resiliently mounted centrally in the slot of the first die body and having an upper end surface which is substantially coplanar with the upper surfaces of the first and second die bodies, the sheet when placed thereon being pinched between the upper end surface of the plunger and the upper die upon application of a bending force to the punched sheet.

11. A lower die assembly as recited in claim 8, wherein the holding means comprises at least one plunger resiliently mounted centrally in the slot of the first die body and having an upper end surface which is substantially coplanar with the upper surfaces of the first and second die bodies, the sheet when placed thereon being pinched between the upper end surface of the plunger and the upper die upon application of a bending force to the punched sheet.

12. A lower die assembly as recited in claim 11, further comprising a plurality of plungers equidistantly spaced apart along a length of the slot of the first die body.

13. A lower die assembly as recited in claim 12, wherein each plunger is spring biased into an extended position in which the upper end surface is substantially coplanar with the upper surfaces of the first and second die bodies.

14. A lower die assembly mountable on a die block of a bending machine for bending a piece of sheet metal and having an upper die movable above the lower die, the lower die comprising:

a first die body having an upper surface, a lower surface, and opposite side walls;

a bending slot formed longitudinally in the upper surface of the first die body, and cooperating with the upper die for effecting a bend in the piece of sheet metal;

means, disposed at the lower surface of the first die body, for fixing the longitudinal position of the first die body along the die block;

a second die body having an upper surface, a lower surface, and opposite side walls, and having one side wall detachably connected to one side wall of the first die body, the upper surfaces of the first and second die bodies being coplanar and forming a sheet retaining surface for receiving thereon a sheet having attachment holes and positioning holes thereon;

at least one pin stop extending upwardly from the upper surface of the second die body at a predetermined distance from the slot formed in the upper surface of the first die body, for mating with one of the sheet positioning holes of the sheet; and means for adjusting the longitudinal position of the pin stop, wherein the means for adjusting the longitudinal position of the pin stop coprises a groove formed longitudinally in the upper surface of the second die body parallel to the slot of the first die body, a pin block slidably received in the groove of the second die body, and means for fixing the longitudinal position of the pin block.

15. A lower die assembly as recited in claim 14, wherein the pin block has an upper surface, a lower surface, and opposite side walls, and the means for fixing the longitudinal position of the pin block comprises a longitudinal groove formed in one of the side walls of the pin block, a plurality of threaded bores extending laterally through the second die body from one side wall thereof to the longitudinally extending groove of the die block, and a set screw treadedly engaging one of the threaded bores and having an inward end movable into abutment with the pin block to fix the position of the pin block at a predetermined longitudinal position.

* * * * *